US010836570B2

(12) United States Patent
Oriols Gaja

(10) Patent No.: US 10,836,570 B2
(45) Date of Patent: Nov. 17, 2020

(54) DEVICE FOR OPENING AND CLOSING CONTAINER LIDS

(71) Applicant: GRIFOLS WORLDWIDE OPERATIONS LIMITED, Dublin (IE)

(72) Inventor: Joan Oriols Gaja, Barcelona (ES)

(73) Assignee: GRIFOLS WORLDWIDE OPERATIONS LIMITED, Dublin (IE)

( * ) Notice: Subject to any disclaimer, the term of this patent is extended or adjusted under 35 U.S.C. 154(b) by 0 days.

(21) Appl. No.: 16/171,257

(22) Filed: Oct. 25, 2018

(65) Prior Publication Data

US 2019/0168960 A1 Jun. 6, 2019

(30) Foreign Application Priority Data

Dec. 1, 2017 (EP) ..... 17382828

(51) Int. Cl.
*B65D 90/10* (2006.01)

(52) U.S. Cl.
CPC ..... *B65D 90/10* (2013.01)

(58) Field of Classification Search
CPC .. B65D 90/10; B65D 51/243; B65D 47/2018; B65D 43/26; B65D 2547/04; B65D 2251/1058
USPC ..... 16/255–256, 291, 325; 220/211, 260, 220/263–264, 280, 827, 830; 403/327; 404/25; 49/386
See application file for complete search history.

(56) References Cited

U.S. PATENT DOCUMENTS 2,729,416 A * 1/1956 Waas ..... A47J 36/12 220/830
4,372,461 A * 2/1983 Lerman ..... B01J 19/0053 220/211
5,038,520 A * 8/1991 Amorese ..... E05F 1/1261 49/386
8,057,123 B2 * 11/2011 Monneret ..... E02D 29/14 404/25
2001/0044986 A1 11/2001 Wilkins

FOREIGN PATENT DOCUMENTS

EP 0260436 A2 3/1988
EP 3085643 A1 * 10/2016 ..... B65D 90/10
EP 3085643 A1 10/2016
FR 1444084 A 7/1966

OTHER PUBLICATIONS

European Search Report of corresponding Patent Application No. EP 17382828—7 pages (dated Apr. 25, 2018).

* cited by examiner

*Primary Examiner* — Chun Hoi Cheung
*Assistant Examiner* — Brijesh V. Patel
(74) *Attorney, Agent, or Firm* — Knobbe, Martens, Olson & Bear, LLP

(57) ABSTRACT

A device for opening and closing container lids is configured for controlling the movement of a lid during the opening and closing of the lid. The device includes a fixed plate, which is connected to the container, a spring, which generates a force on the lid, the magnitude of which varies according to the relative position of the lid, and a common rotary shaft that hinges the lid to the fixed plate. The lid receives force of the spring at a point that is remote from the common rotary shaft such that the force exerted by the spring compensates for the weight of the lid.

10 Claims, 14 Drawing Sheets

DEVICE FOR OPENING AND CLOSING CONTAINER LIDS

BACKGROUND

Technical Field

The present application discloses a device for opening and closing container lids in order to control the movement of the lid during opening or closing thereof. More specifically, the present application discloses a device for controlling and minimising the force of impact of the lid against the container at the moment of closure. The device also helps the user open the lid, such that the user has to apply less pushing force to the weight of the lid when opening it.

Related Art

There are different types of containers that have openings known as "manways" for providing access to said containers. Thus, manways are openings which have covers or lids that are fitted on a container and retract against a gasket. Said lids are usually hinged lids, and are understood to be a type of lid that has two elements that are hinged by a common shaft and in which the lid is generally movable and the container is stationary, allowing rotation of the lid about the common shaft in order to change the position of the lid.

A gasket is a mechanical seal which fills the space between two or more mating surfaces, generally to prevent leakage when said surfaces are under compression. In particular, the gasket is annular and located on the rim of the opening and is used to prevent the fluid contained inside the container from escaping when the lid of the manway is in the closed position.

The lids of the manways are usually of considerable weight, weighing up to more than 40 kilograms. Users responsible for handling the containers frequently encounter problems or difficulties when opening or closing the lid, owing, among other factors, to the weight thereof. The difficulty with regard to closing the lid is related to the high speed of the lid at the moment of closure and to the lack of control during said closure. The kinetic energy of the lid resulting from the speed and mass thereof is transformed into impact energy when the lid contacts the container. Currently, numerous accidents are caused by the lid closing unexpectedly while the user's fingers are on the rim of the manway, crushing them at the moment of closure. Another problem relating to the closure of the lid is the deformation of the gasket produced by repeated impact of the lid. The aim of the gasket is to prevent leakage of fluid and permanent deformation may cause undesirable leaks.

SUMMARY

It is therefore important to provide a lid-opening device that comprises a system for resolving the difficulty when both opening and closing the lid by means of one device, and in particular for preventing users from suffering injuries on any part of their body at the moment of closure.

The present application discloses a technical solution to the aforementioned technical problems using the force of a spring to compensate for the weight of the lid. The spring may be replaced or the mechanical properties thereof may be modified in order to achieve a particular behaviour of the lid both during the opening and closing processes. In accordance with an aspect of the present invention, compensating for the weight of the lid using the force of a spring makes it possible to kinematically and dynamically control the lid.

An aspect of the present invention is to provide versatility within one device during the process of opening and closing the lid. The device for opening and closing lids on containers compensates for the weight of the lid in order to ensure that the impact of the lid against the container is controlled.

More specifically, an aspect of the present invention is to provide a lid-opening and closing device which has resilient means for compensating for the weight of the lid depending on the mass and position thereof.

In order to achieve this, an embodiment of the present invention discloses a device for controlling the movement of a lid during the opening and closing thereof, characterised in that it comprises: a fixed structure which is connected to the container; a resilient means which generates a force on the lid, the magnitude of which varies according to the relative position of the lid; and a common rotary shaft that hinges the lid to the fixed structure, the lid receiving the force of the resilient means at a point that is remote from the common rotary shaft, which is arranged such that the force exerted by the resilient means compensates for the weight of the lid.

Preferably, the resilient means is connected to the fixed structure by means of a hinge which allows the force of the resilient means to be transferred to said fixed structure and moreover allows said resilient means to tilt. More preferably, the resilient means is connected to the lid by means of a hinge which allows said resilient means to tilt.

Preferably, the device comprises a movable structure which is connected to the lid and hinged to the fixed structure by means of the common rotary shaft, such that rotation of said movable structure about said common rotary shaft is possible.

Preferably, the device comprises a bar that is hinged with respect to the movable structure and with respect to the fixed structure, the longitudinal axis of the bar coinciding with the longitudinal axis of the resilient means, such that said hinge between the bar and the movable structure moves in a circular manner with respect to the common shaft during movement of the lid.

Preferably, the resilient means is arranged between the fixed structure and a retaining nut, such that when the lid makes an opening or closing movement, the movable structure rotates about the common rotary shaft causing a change in the length of the resilient means.

Preferably, the common rotary shaft is a first bolt or long bolt that hinges the movable structure and the fixed structure, whereas the hinge between the movable structure and the bar is a second bolt, also referred to as the short bolt.

Preferably, a recess in the fixed structure has a shape that matches the travel of the short bolt, thus allowing said bolt to be received, such that when the lid has reached the open position, one end of the short bolt contacts a wall of the recess, stopping the opening movement of the lid.

Preferably, one end of the fixed structure is at a substantially lower height than the upper corner of the recess in the fixed structure, such that said end acts as a stop against the lid in the open position.

Preferably, the device comprises a casing in the shape of a handle, referred to in the following as "handle", the longitudinal axis of which coincides with the longitudinal axis of the resilient means.

Preferably, the upper portion of the handle connects at the top to the bar by means of at least one fixing sleeve and at the bottom to the upper portion of the resilient means, such that the force exerted by the resilient means is received by the upper portion of the handle, transferring said force in turn to the bar, which in turn transfers said force to the movable structure via the short bolt.

Preferably, the resilient means is a spring that is always tensioned, apart from when the lid is at 90° with respect to the manway.

Preferably, the device comprises two movable structures and two fixed structures. More preferably, the movable structures and the fixed structures have the shape of a rigid, planar plate.

Embodiments of the present invention makes it possible to arrange the resilient means or spring in such a way as to match or compensate for the action of the weight throughout the entire travel of the lid.

BRIEF DESCRIPTION OF THE DRAWING

To aid understanding, explanatory yet non-limiting drawings of two embodiments of a device for opening and closing container lids are included.

DETAILED DESCRIPTION

In the following, two embodiments of the present invention are described with reference to the accompanying drawings: a first embodiment in which the lid is opened to 180°, and a second embodiment in which the lid is opened to 90°.

Figure 1:
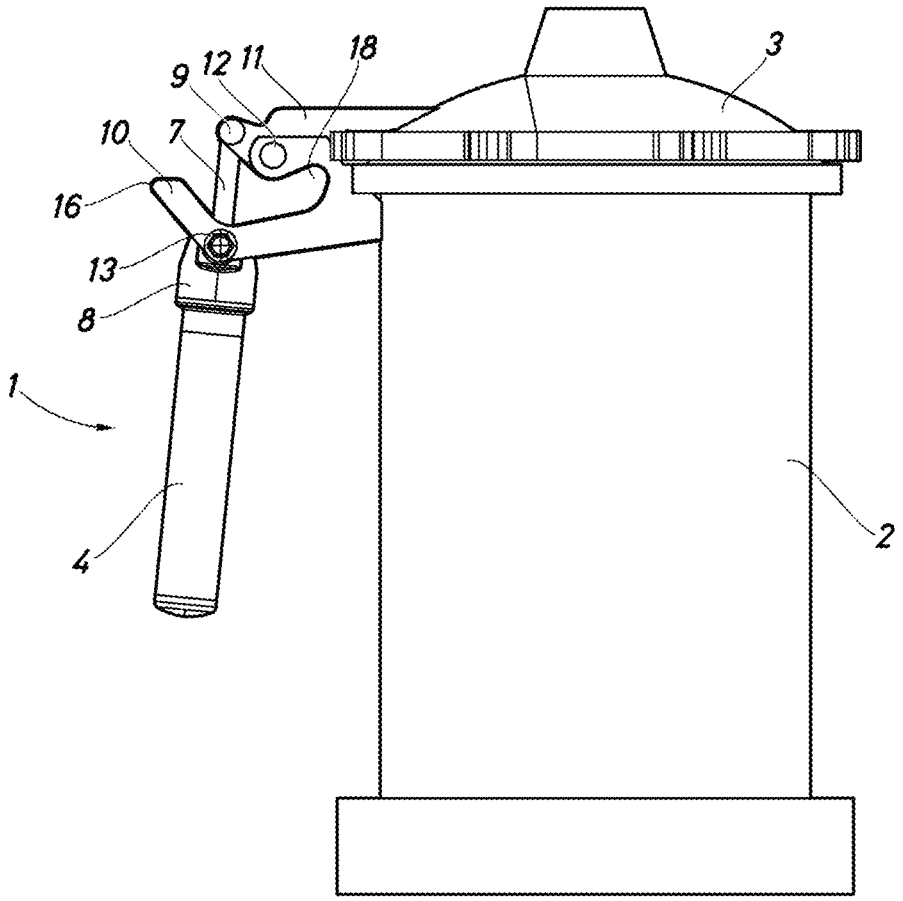
FIG. 1 is an elevation view of a device for opening and closing lids according to embodiments of the present invention, arranged on a container on which the lid is closed.
Figure 2:
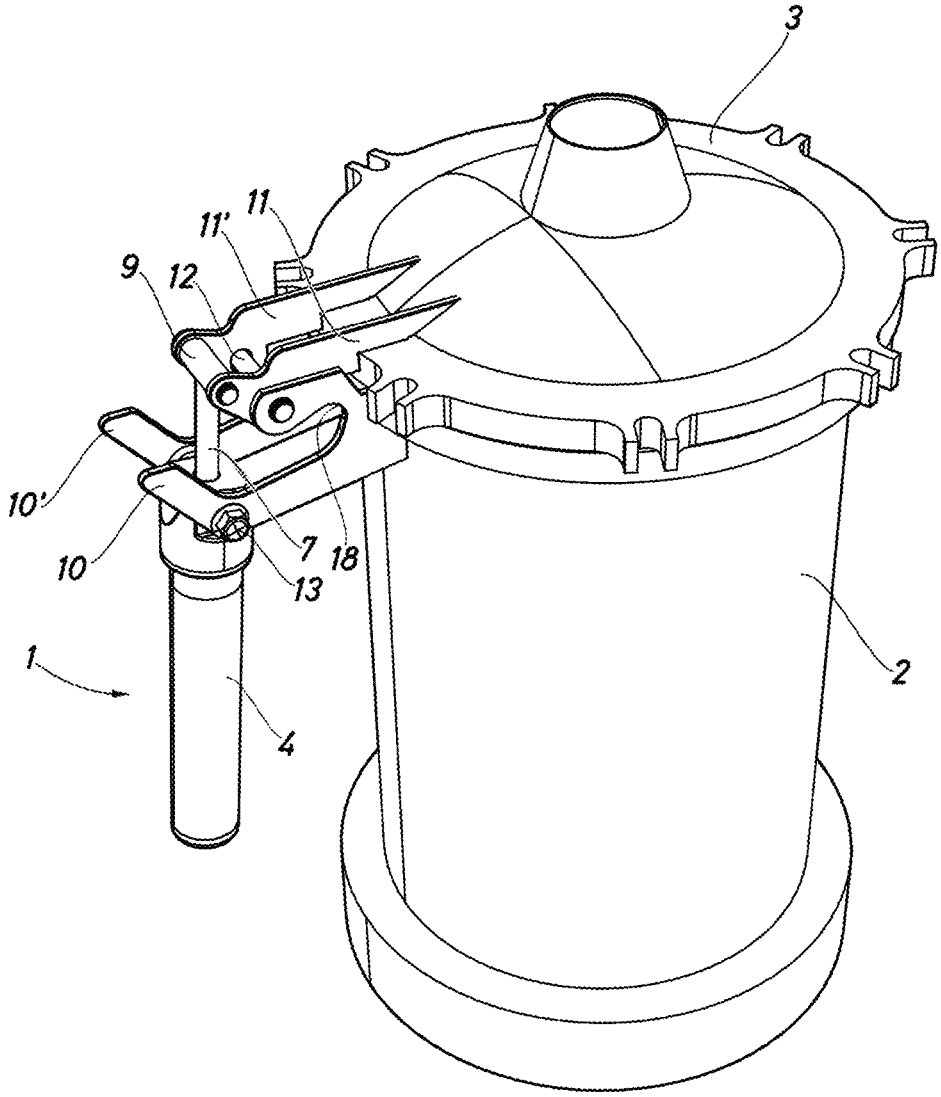
FIG. 2 is a perspective view of the device for opening and closing lids from FIG. 1.

FIGS. 1 and 2 shows a first embodiment of a device -1- for opening and closing lids that is arranged on a container -2-, the lid -3- being closed. FIG. 1 thus shows the device -1- connected to the lid -3- by means of the movable structure -11- and to the container -2- by means of the fixed structure. In particular, the movable structure is a movable plate -11- and the fixed structure is a fixed plate -10-.

The device -1- of the present embodiment comprises a spring -5- (shown in FIG. 6), a handle -4-, two fixed plates -10- and -10'-, two movable plates -11- and -11'- and a bar -7-. The spring -5- is located inside the handle -4-, and therefore FIGS. 1 and 2 do not show said spring -5-. The longitudinal axis of the bar -7- coincides with the longitudinal axis of the handle -4-. Furthermore, the longitudinal axis of the bar -7- coincides with the longitudinal axis of the spring -5-.

The movable plates -11- and -11'- are rigid, planar elements that are substantially elongate and rigidly connected to the lid -3- by one of their ends. The other end of the movable plates -11- and -11'- is rounded and has a substantially circular hole for receiving a second bolt, also referred to as the short bolt -9-. The longitudinal axis of the short bolt -9- is perpendicular to the movable plates -11- and -11'- and the movable plates -11- and -11'- are arranged symmetrically with respect to the elevation plane. Furthermore, said movable plates comprise a second substantially circular hole for receiving a second bolt, also referred to as the long bolt -12-. The longitudinal axis of the long bolt -12- is perpendicular to the movable plates -11- and -11'-.

The fixed plates -10- and -10'- are rigid, planar elements that are connected to the outer walls of the container. Said fixed plates comprise a substantially L-shaped recess -18-, the inner corners of which are substantially rounded, allowing circular movement of the movable plates -11- and -11'- on a first bolt, also referred to as the long bolt -12-. Said circular movement finishes when the ends of the short bolt -9- come into contact with the upper inner corner of the recess -18-. Furthermore, the fixed plates -10- and -10'- comprise two holes: a first substantially circular hole for receiving a 16-mm screw -13- and a second substantially circular hole for receiving the long bolt -12-. Said long bolt -12- is the common rotary shaft which allows the movable plates -11- and -11'- to rotate on the fixed plates -10- and 10'-, which are arranged symmetrically with respect to the elevation plane.

The bar -7- is a rigid rod that is elongated in the shape of a cylinder and is not hollow. The bar -7- comprises a threaded region on the lower end, whereas the other end comprises a tube, the longitudinal axis of which is arranged perpendicularly to the longitudinal axis of the rigid rod. Because the tube is hollow, it can receive the short bolt -9-. The threaded end of the bar -7- is used to secure the nut -14- in position and thus to configure the mechanical properties of the spring -5-. Therefore, the bar -7- is hinged by two hinge points: at the top to the movable plates -11- and -11'- by means of a short bolt -9- and to the fixed plates -10- and -10'- by means of two screws -13- and -13'-.

The two screws -13- and -13'- screw into the upper portion -8- of the handle -4-, such that said screws -13- and -13'- pass through the fixed plates -10- and -10'-. This configuration of the screws -13- and -13'- is advantageous for allowing oscillating movement of the handle -4- and of the bar -7- with respect to the fixed plates -10- and -10'-, which are rigidly connected to the container -2-.

Furthermore, the bar -7- comprises a first fixing sleeve -19- and a second fixing sleeve -20- in an intermediate portion of the rod, such that both sleeves -19- and -20- are wedged inside the upper portion -8- of the handle -4-, restricting axial movement of the bar -7- with respect to said upper portion -8- of the handle -4-. Therefore, the force of the spring -5- is transmitted to a face of the upper portion -8- of the handle -4- arranged perpendicularly to the longitudinal axis of the spring -5-, and said face transfers said force to the bar -7- via the fixing sleeves -19- and -20-.

The upper portion -8- of the handle -4- has an outer geometry that is similar to a rectangular prism. It is a detachable connection element between the bar -7-, the fixed plates -10- and -10'- and the handle -4- itself. The upper portion -8- of the handle -4- comprises a threaded region for enabling a threaded connection to the handle -4-.

The handle -4- is in the shape of a tube, comprising a threaded region at the top where it is screwed into the upper portion -8- of the handle -4-, and a lid at the bottom. One advantage is that the spring -5- can be replaced by another spring or the mechanical properties thereof can be modified.

The device -1- operates in the following manner: the user opens the lid -3- by means of grips (not shown) or another mechanism not related to the present invention. It is important to note that the user applies no direct force to the device -1- in order to open or close the lid. Since the lid is a hinged lid and is rigidly connected to the movable plates -11- and -11'-, the long bolt -12- can be a rotary shaft. The movable plate -11- converts the rotational movement of the long bolt -12- into a circular movement at the hinge point -9- with the upper end of the bar -7-. Said hinge point -9- is a short bolt -9-. The short bolt -9- does not coincide geometrically with the long bolt -12-, i.e. there is a gap, referred to as eccentricity, between the two bolts. The upper portion of the bar -7- moves in a circular manner with respect to the long bolt -12-, whereas the lower portion of said bar -7- moves (swings) substantially towards the right (anticlockwise direction) of FIG. 1 during the first moments of opening of the lid -3-, until the short bolt -9- and the long bolt -12- are at the same height in FIG. 1, at which point the bar -7- starts to swing towards the left (clockwise direction). This swinging movement in the clockwise direction continues until the lid is opened to approximately 180°.

Figure 3:
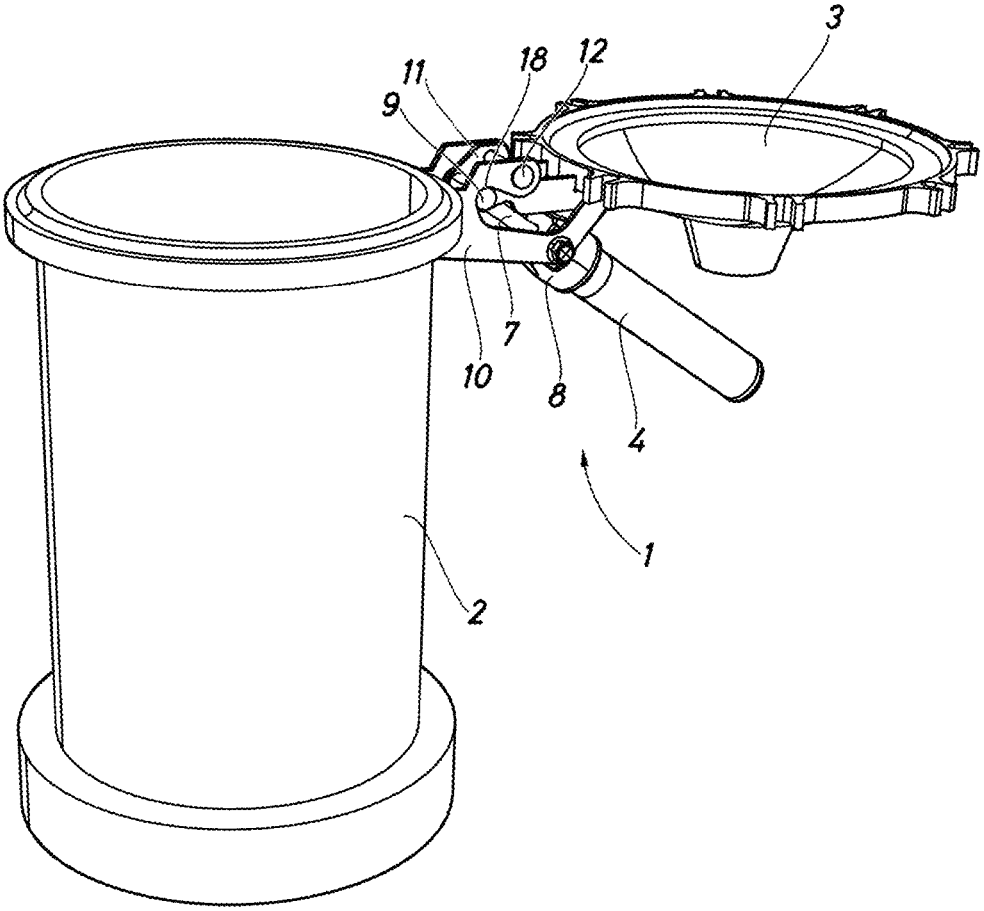
FIG. 3 is a perspective view of the device for opening and closing lids on a recipient, the lid being open at 180°.
Figure 4:
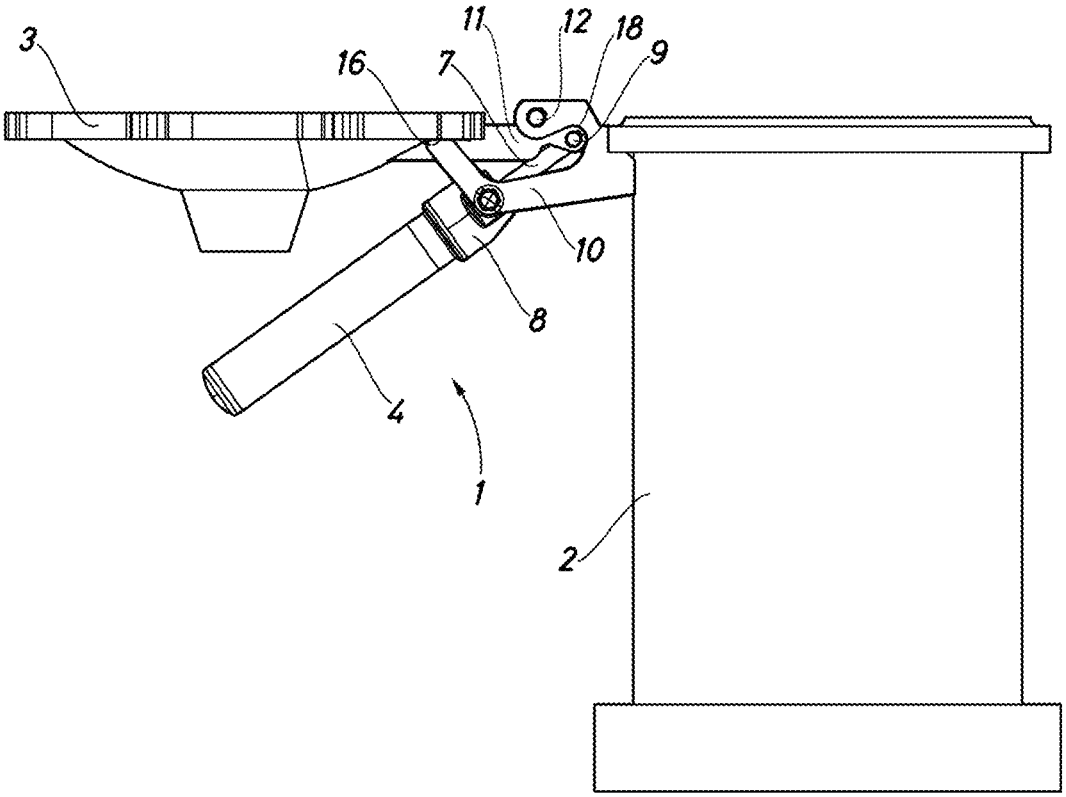
FIG. 4 is an elevation view of the device for opening and closing lids from FIG. 3.

FIGS. 3 and 4 show the end of the opening movement when the lid has opened to approximately 180° according to a first embodiment. At this moment, the upper inner corner of the recess -18- and an end -16- of the fixed plate -10- act as stops, restricting the opening movement of the lid -3-. The short bolt -9- is inserted into the recess -18-, which has a matching shape, thus allowing the short bolt -9- to be received until it contacts the upper inner corner of the recess -18-. Furthermore, the outer face of the lid -3- contacts the end -16- of the fixed plate -10-. The open position is understood to mean the position in which the lid -3- is completely open, corresponding to 180° in the first embodiment.

When the lid -3- is closed, the spring -5- is stretched, i.e. operates in a tensile manner, thus pulling the bar -7- downwards and as a result substantially compensating for the weight of the lid. When the lid -3- is in a 90° position, the spring -5- is balanced, i.e. it is neither stretched nor compressed. When the lid -3- is in a position between 90° and 180°, the spring -5- progressively stretches again until the lid is opened to 180°, which corresponds to the maximum elongation of the spring -5- together with the closed position, pushing the bar -7- downwards and as a result substantially compensating for the weight of the lid -3-. Therefore, the force of the spring -5- varies according to the relative position of the lid -3-. The force of the spring -5- is transmitted directly to the upper portion -8- of the handle -4- and said upper portion transmits said force to the bar -7- in a direction that is longitudinal to said bar, and said bar in turn transmits said force to the movable plates -11- and -11'- via the short bolt -9-.

Figure 5:
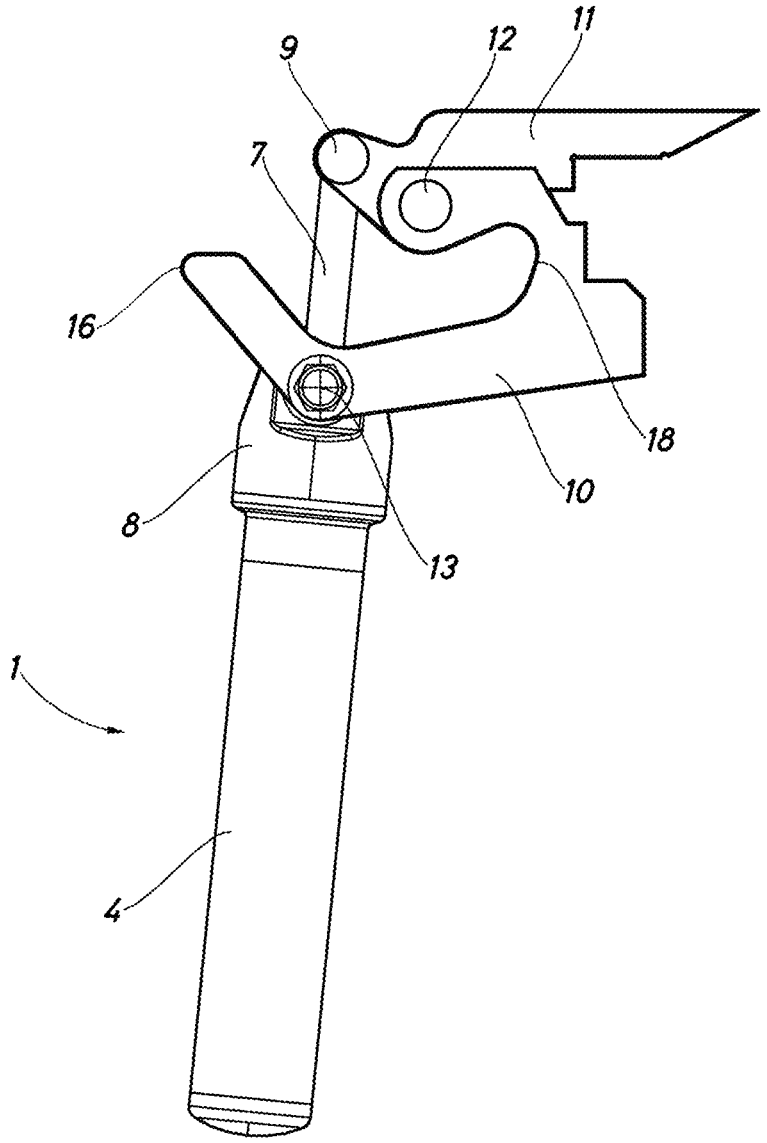
FIG. 5 is an elevation view of a device for opening and closing lids that is separated from the container.

FIG. 5 shows the device -1- of the first embodiment without the container -2- and lid -3-. FIG. 5 shows the mechanism comprising three hinge points: a first hinge point -12- between the movable plate -11- and the fixed plate -10-, a second hinge point -9- between the bar -7- and the movable plate -11- and a third hinge point -13- between the bar -7- and the fixed plate -10-. The first hinge point -12- is a long bolt -12-, the second hinge point -9- is a short bolt -9- and the third hinge point -13- is produced by means of two screws -13- and -13'-. The long bolt -12- moves in a rotational manner, but not in a translational manner, be it linear or circular translation. Indeed, the longitudinal axis of the long bolt -12- is the axis of rotation of the mechanism.

Figure 6:
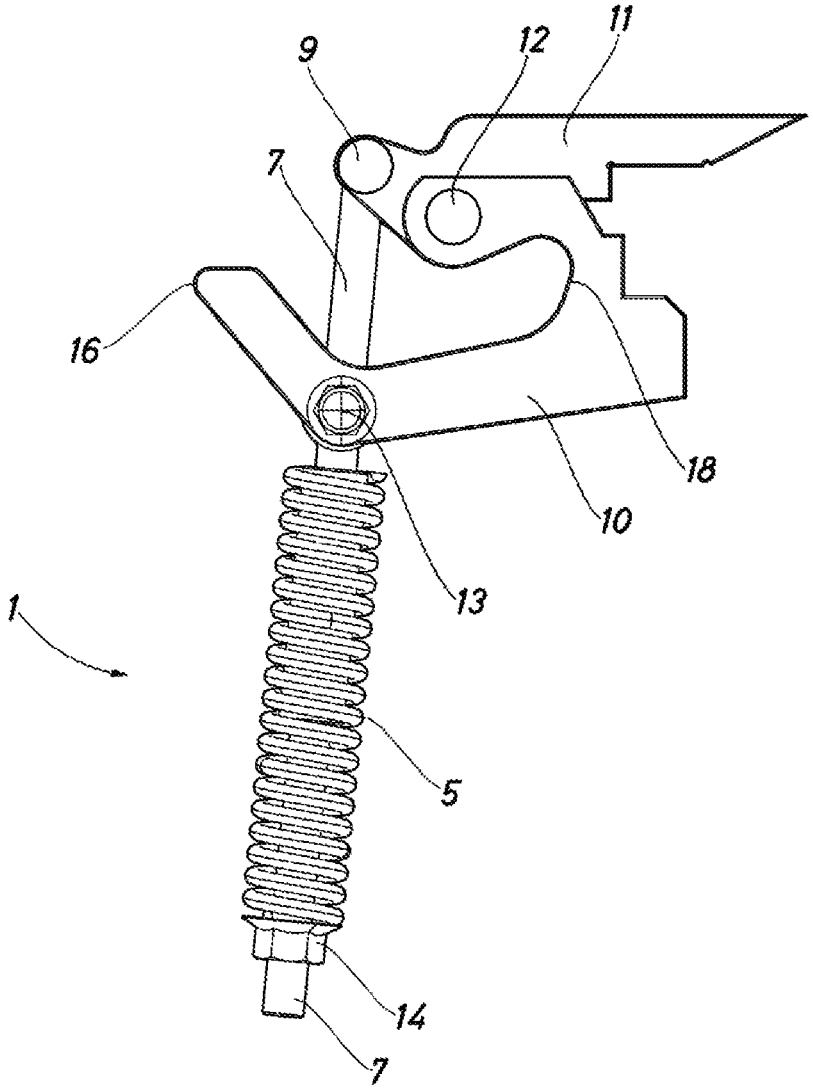
FIG. 6 is an elevation view of a device for opening and closing lids from FIG. 5, showing the spring located inside the handle.

FIG. 6 shows the device -1- from FIG. 5 without the handle -4-, thus showing the spring -5- and other elements inside the handle -4-. The spring -5- is contacted at the bottom by means of a nut -14- and at the top by means of the upper portion -8- of the handle -4-. The mechanical features of the spring -5-, for example the force exerted on the upper portion -8- of the handle -4- or the constant of proportionality, known as the spring constant, are easily configurable by changing the distance between the lower nut -14- and the upper portion -8- of the handle -4-. When the screw -14- is unscrewed, it recedes in the direction of the longitudinal axis of the bar -7-, stretching the spring -5- and as a result increasing the spring constant. By increasing the spring constant, the force exerted by the spring -5- is proportionally greater for each stretched unit of length according to Hooke's law. Conversely, the threading of the nut -14- causes the nut to advance in the direction of the longitudinal axis of the bar -7-, stretching the spring -5- less and less and as a result reducing the spring constant. The mechanical properties of the spring -5- are therefore configurable.

Likewise, the user may configure the device -1- such that the lid never closes under its own weight and remains balanced, for example, at 30 millimetres from the closed position. For this, the user can use fundamental trigonometry theorems to determine the angle of the lid in an open position of for example 30 millimetres, and calculate the effective weight of the lid -3- that receives the spring -5- and thus adjust the position of the nut -14- such that the tensioned spring exerts a force that is equal to the effective weight of the lid -3- at thirty millimetres from the closed position, thus ensuring that the system is balanced.

There is also the option of adjusting the spring -5- such that the tensile force is substantially less than the effective weight of the lid -3-, such that when the lid -3- is in an open position of less than 90°, the lid -3- closes under its own weight without any help from the user and in a controlled manner at a relatively low speed, it being possible to control the impact force at the moment when the lid -3- contacts the container -2-. The user can therefore configure the device -1- such that the impact of the lid -3- is of a force equivalent to 15 newtons, for example.

Figure 7:
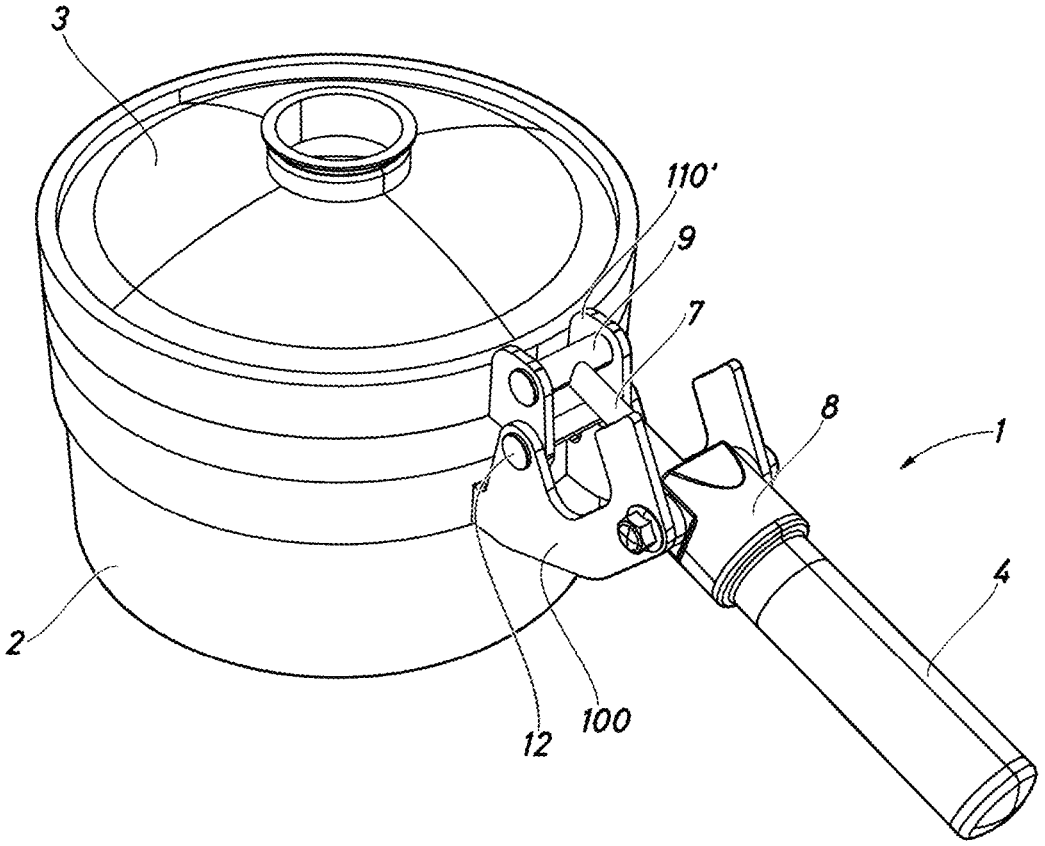
FIG. 7 is a perspective view of a second embodiment of the device for opening and closing lids, arranged on a container on which the lid is closed.
Figure 8:
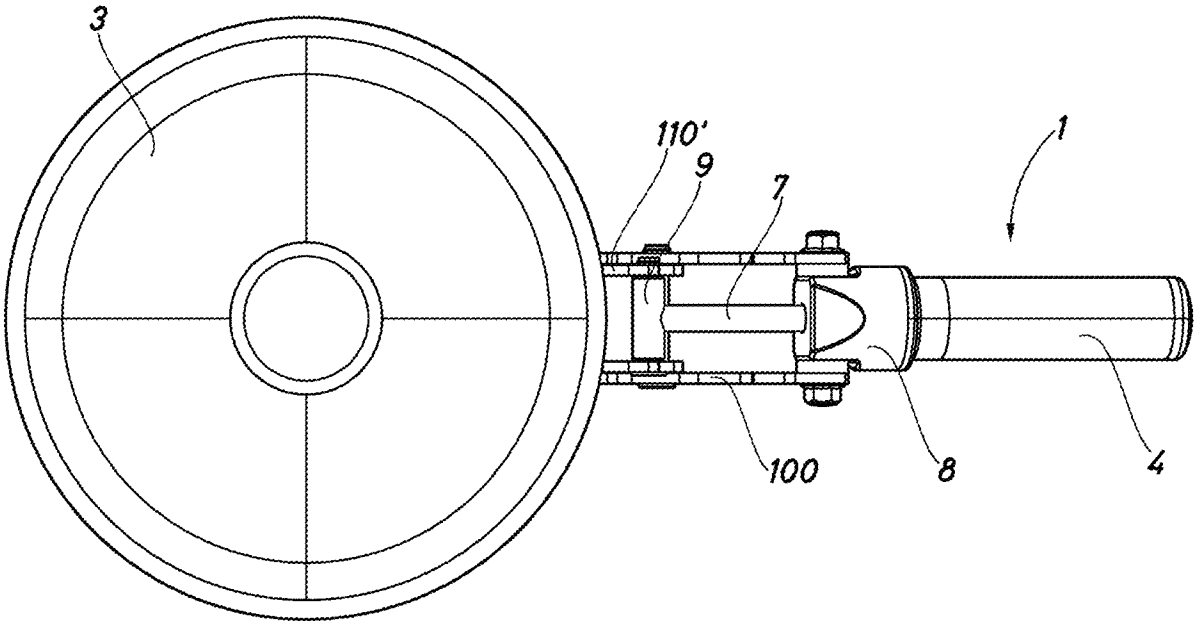
FIG. 8 is a view from above the second embodiment of the device for opening and closing lids from FIG. 7.
Figure 9:
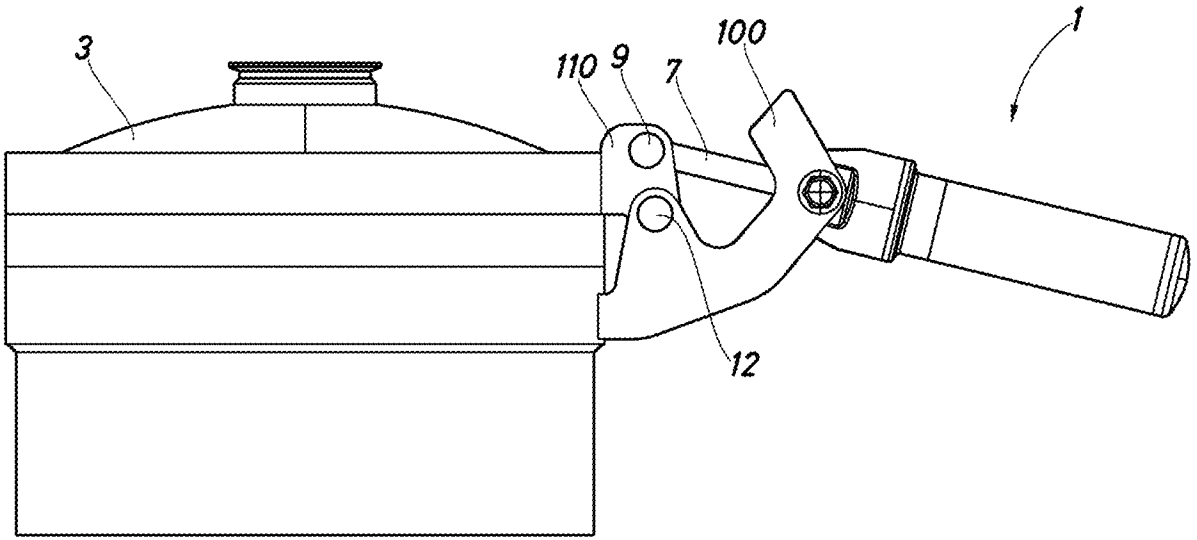
FIG. 9 is a side elevation view of the second embodiment of the device for opening and closing lids from FIG. 8 joined to a container, the lid being closed.

FIGS. 7, 8 and 9 show a second embodiment in which the lid is closed. The second embodiment corresponds to an open position of 90°, the fixed plates -100- and -100'- and the movable plates -110- and -110'- having a geometry that is substantially different from the plates in the first embodiment. The movable plates -110- and -110'- have a substantially rectangular shape having the four corners rounded and one hole for receiving a short bolt -9- and another hole for receiving the long bolt -12-. Said short bolt -9- connects the upper end of the bar -7- to the two movable plates -110- and -110'- and said movable plates to the lid -3-. The fixed plate -100- has a rectangular recess having the rounded corners and dimensions which allow the short bolt -9- to be inserted during the clockwise swinging movement of the movable plates -110- and -110'- with respect to the short bolt -9-. Furthermore, the fixed plates -100- and -100'- comprise a hole for receiving a long bolt -12- and another hole for receiving a screw -13-.

As is the case in the first embodiment, the mechanism comprises three hinge points: a first hinge point consisting of a long bolt -12- which connects the movable plates -110- and -110'- and the fixed plates -100- and -100'-, a second hinge point consisting of a short bolt -9- which connects the bar -7- and the two movable plates -110- and -110'-, and a third hinge point consisting of two screws -13- and -13'-.

Figure 10:
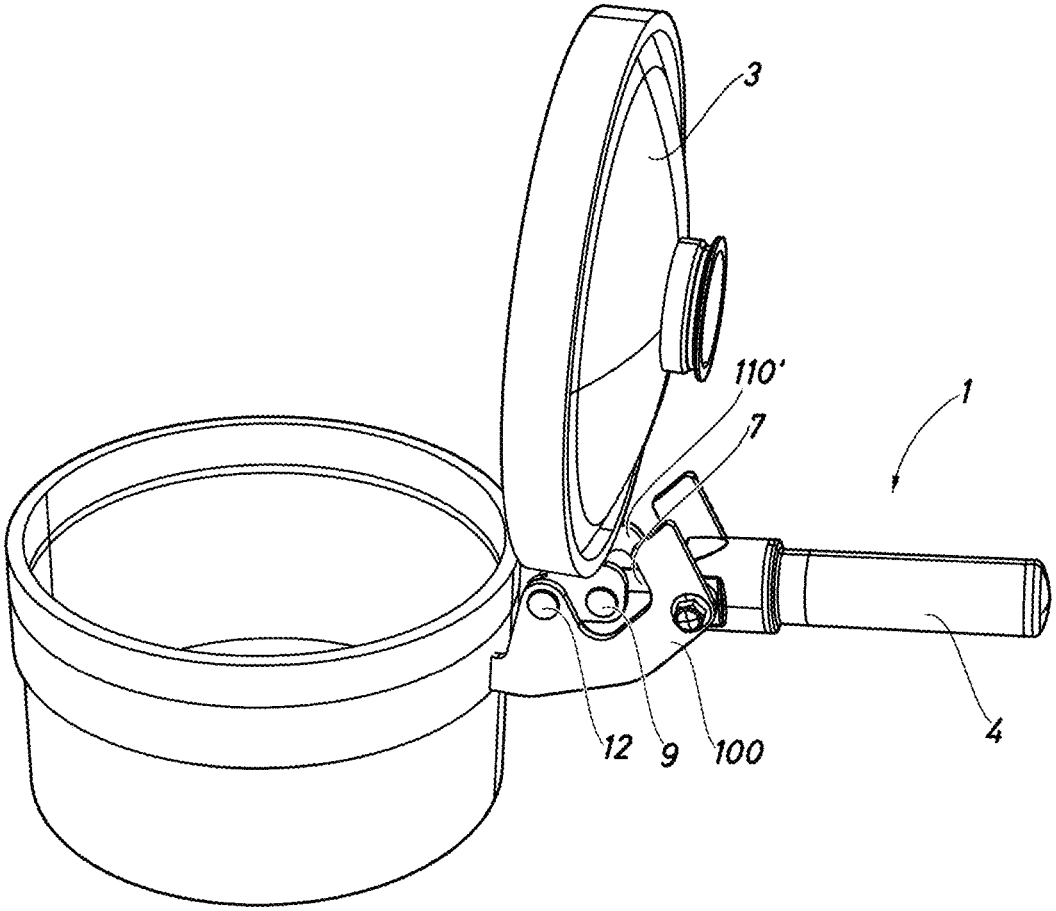
FIG. 10 is a perspective view of the second embodiment of the device for opening and closing lids from FIG. 9, the lid being open at 90°.
Figure 11:
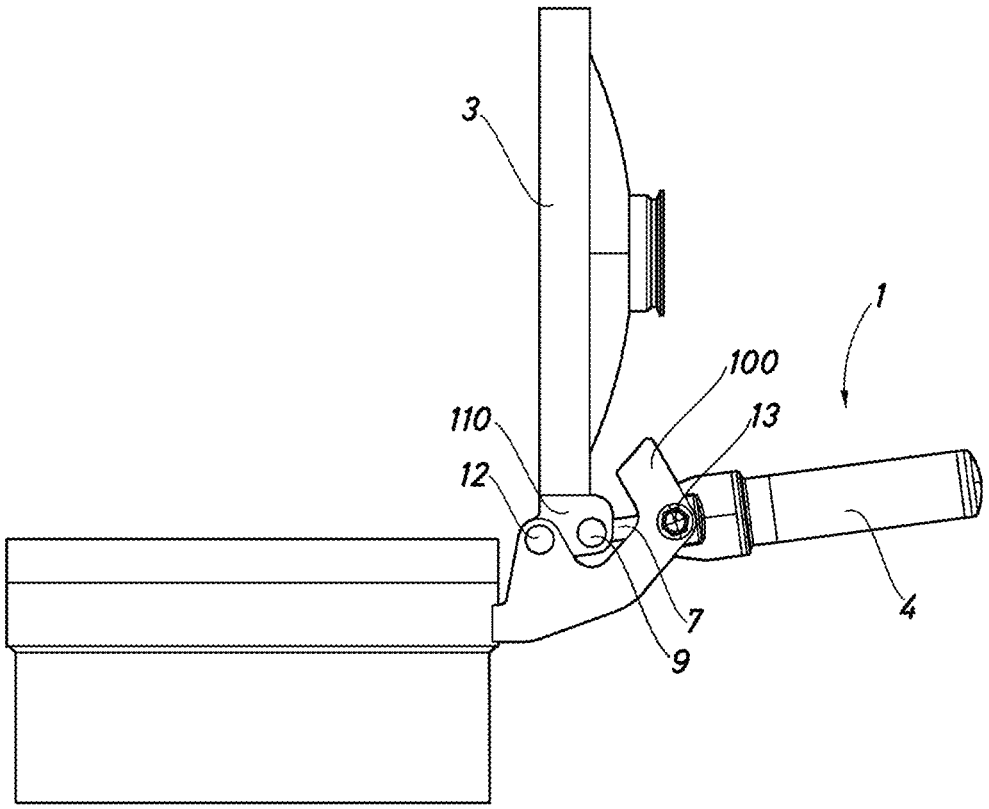
FIG. 11 is a side elevation view of the second embodiment of the device for opening and closing lids from FIG. 10.
Figure 12:
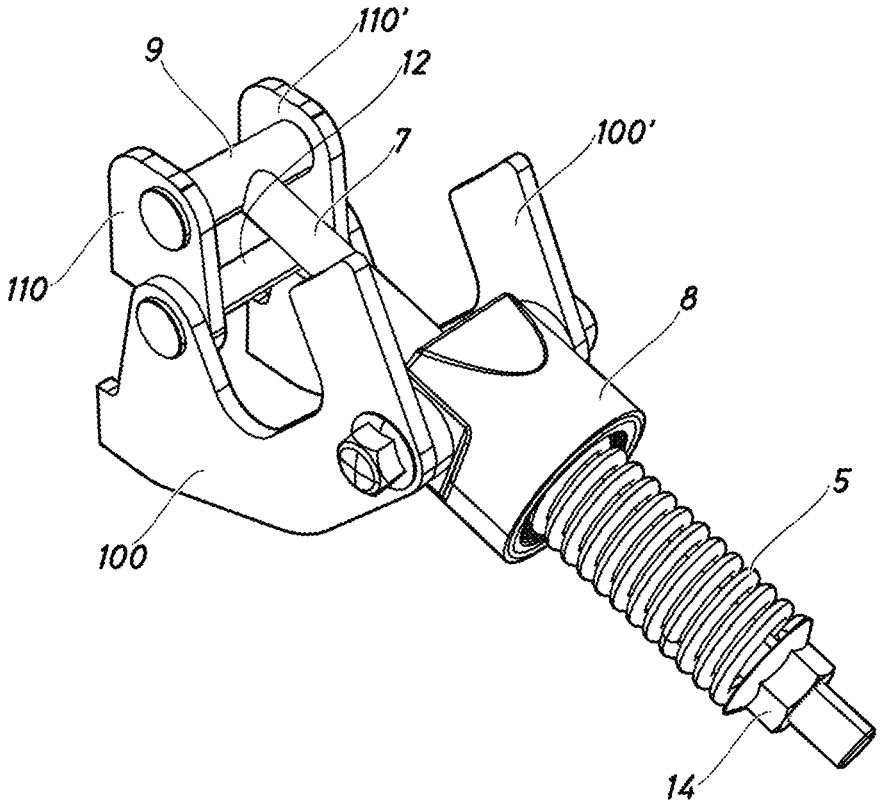
FIG. 12 is a perspective view of a second embodiment of the device for opening and closing lids, separated from the container, showing the spring located inside the handle.
Figure 13:
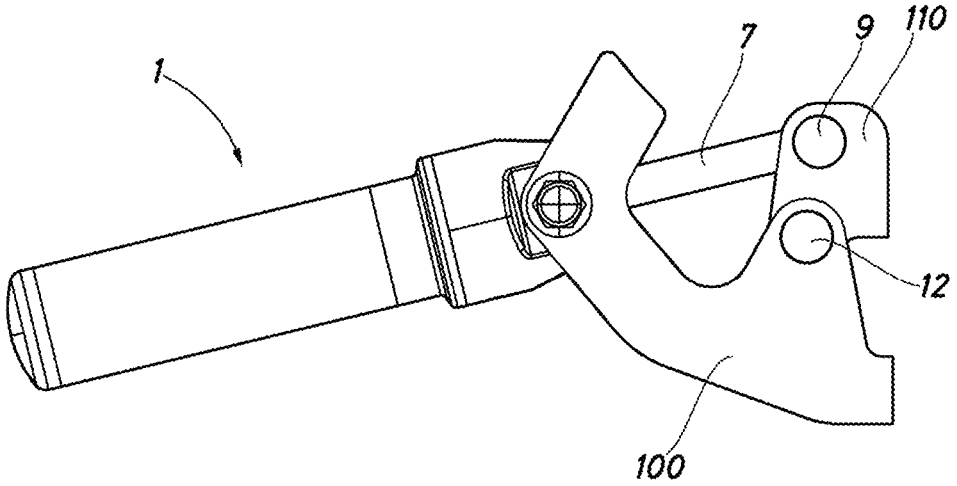
FIG. 13 is a side elevation view of the second embodiment of the device for opening and closing lids from FIG. 12, comprising the handle that covers the spring.
Figure 14:
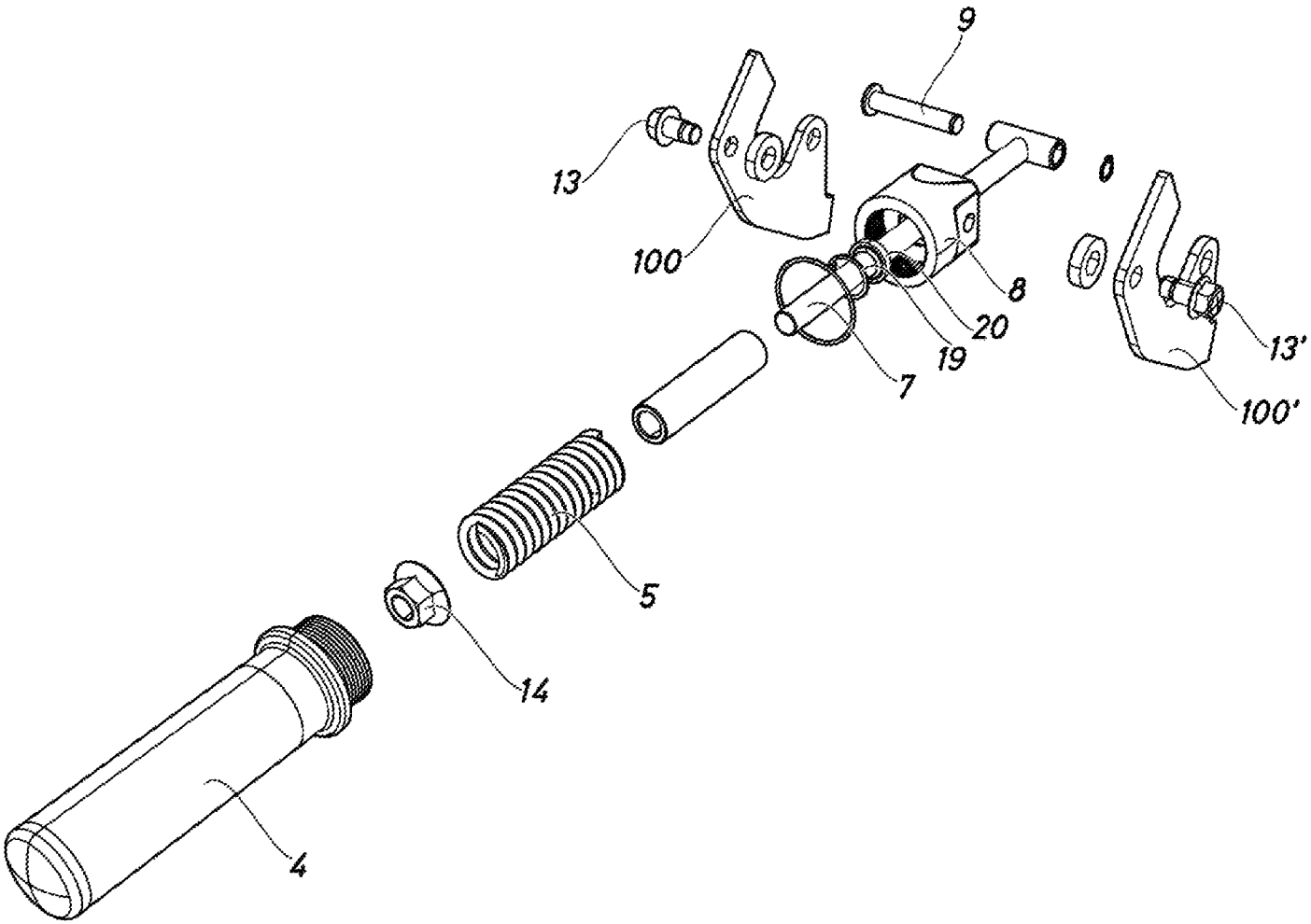
FIG. 14 is an exploded view of the second embodiment of the device for opening and closing lids.

FIGS. 10 and 11 show a second embodiment in which the lid is opened to 90°. The device -1- of the present embodiment is designed to restrict the movement of the lid -3- when said lid opens to substantially more than 90°. This is achieved by means of the direct contact of the ends of the short bolt -9- with one of the rounded corners of the recess in the fixed plate -100-.

The two movable plates -110- and -110'- are permanently connected to the lid -3-, for example by means of welding, whereas the two fixed plates -100- and -100'- are permanently connected to the lateral face of the container -2-, and therefore the present embodiment allows the movable plates -110- and -110'- to swing with respect to the long bolt -12-, said long bolt being the axis of rotation of the mechanism.

Although the invention has been set out and described with reference to embodiments thereof, it should be understood that these do not limit the invention, and that it is possible to alter many structural or other details that may prove obvious to persons skilled in the art after interpreting the subject matter disclosed in the present description, claims and drawings. Therefore, the scope of the present invention includes any variant or equivalent that could be considered covered by the broadest scope of the following claims.

What is claimed is:

1. A device for opening and closing a lid of a container and for controlling movement of the lid during opening or closing thereof, wherein the device comprises:

a fixing plate fixed to the container;

a movable plate connected to the lid and to move together with the lid;

a common rotary shaft coupling the movable plate and the fixing plate such that the movable plate rotates relative to the fixing plate about the common rotary shaft according to opening or closing of the lid;

a bar coupled to the movable plate and to the fixed plate, wherein the bar comprises an upper end, a lower end and a middle portion connecting the upper end and the lower end, wherein the upper end is hingedly coupled to the movable plate by a first hinge separate from the common rotary shaft and the middle portion is hingedly coupled to the fixing plate by a second hinge separate from the common rotary shaft and the first hinge such that the bar rotates relative to the fixing plate and the movable plate according to opening or closing of the lid; and a spring connected to the lower end of the bar and extending along with the bar, wherein the spring is arranged to elastically deform and to exert force to the bar such that the spring exerts force to the movable plate via the bar according to opening or closing the lid and compensating for at least a portion of the lid's weight.

2. The device according to claim 1, wherein a longitudinal axis of the bar coincides with a longitudinal axis of the spring.

3. The device according to claim 1, wherein the spring is arranged between the fixing plate and a retaining nut, wherein the movable plate is configured to rotate about the common rotary shaft causing a change in a length of the spring.

4. The device according to claim 1, wherein the common rotary shaft comprises a first bolt that hingedly connects the movable plate and the fixing plate, whereas the movable plate and the bar is hingedly connected to a second bolt separate from the first bolt.

5. The device according to claim 4, further comprising a recess in the fixed plate, wherein the recess has a shape that matches a trajectory of the second bolt during opening or closing of the lid.

6. The device according to claim 5, wherein one end of the fixing plate is located lower than an upper corner of the recess, such that the end of the fixing plate acts as a stop against the lid when the lid is in its open position.

7. The device according to claim 1, further comprising a handle, wherein a longitudinal axis of the handle coincides with an longitudinal axis of the spring.

8. The device according to claim 7, wherein an upper portion of the handle is connected to the bar using at least one fixing sleeve and is connected to the spring, such that the upper portion of the handle receives force from the spring, transfers force form the spring in turn to the bar.

9. The device according to claim 1, wherein the spring is tensioned except when the lid is at 90°.

10. A container system comprising a container, a lid and the lid-opening device of claim 1 for controlling movement of the lid.

* * * * *